US005532685A

United States Patent [19]

Takahashi

[11] Patent Number: 5,532,685

[45] Date of Patent: Jul. 2, 1996

[54] CALL ALARMING APPARATUS FOR PAGING SYSTEM

[75] Inventor: Satoshi Takahashi, Tokyo, Japan

[73] Assignee: NEC Corporation, Tokyo, Japan

[21] Appl. No.: 233,970

[22] Filed: Apr. 28, 1994

[30] Foreign Application Priority Data

Apr. 28, 1993 [JP] Japan ..... 5-101691

[51] Int. Cl.[6] ..... G08B 5/22

[52] U.S. Cl. ..... 340/825.46; 340/825.44; 340/333; 455/38.3; 455/343

[58] Field of Search ..... 340/825.46, 825.44, 340/311.1, 333; 455/343, 127, 38.3

[56] References Cited

U.S. PATENT DOCUMENTS

| | | | |
|---|---|---|---|
| 4,588,989 | 5/1986 | Yasuda et al. | 340/333 |
| 5,007,105 | 4/1991 | Kudoh et al. | 340/311.1 |
| 5,019,803 | 6/1991 | Maram | 340/333 |
| 5,203,020 | 4/1993 | Sato et al. | 455/127 |
| 5,272,475 | 12/1993 | Eaton et al. | 340/825.46 |
| 5,353,017 | 10/1994 | Suzuki et al. | 340/825.46 |

FOREIGN PATENT DOCUMENTS 63-268323 11/1988 Japan .

*Primary Examiner*—Donald J. Yusko
*Assistant Examiner*—Edward Merz
*Attorney, Agent, or Firm*—Sughrue, Mion, Zinn, Macpeak & Seas

[57] ABSTRACT

A call alarming apparatus for a paging system, includes a receiver, an alarming circuit, a drive circuit, a controller, a first power supply, a second power supply, and a rectifier. The receiver receives a call number as a radio signal. The alarming circuit is driven to alarm a call when the receiver receives a self call number. The drive circuit drives the alarming circuit by inputting a control signal to the drive circuit. The controller outputs a control signal to the drive circuit on the basis of an output from the receiver. The first power supply supplies power to the alarming and drive circuits. The second power supply is automatically switched to supply power to the drive circuit when a power supply voltage of the first power supply drops. The rectifier prevents a current from flowing from the second power supply into the first power supply.

8 Claims, 2 Drawing Sheets

CALL ALARMING APPARATUS FOR PAGING SYSTEM

BACKGROUND OF THE INVENTION

The present invention relates to a call alarming apparatus for a paging system (pager) and, more particularly, to a drive apparatus for a vibration alarming motor (to be referred to as a VIB motor hereinafter).

A VIB motor is generally used as follows. That is, when a pager is individually called with a radio signal, the VIB motor is driven by a power supply battery to vibrate the pager itself or part of the pager, thereby alarming a call to the user of-the pager.

The arrangement of a VIB motor drive apparatus for a conventional pager is shown in FIG. 2. A controller 21 processes reception data from a receiver 20 when the receiver receives a self call number, and the controller 21 outputs an operation signal to a VIB drive circuit 22. The VIB drive circuit 22 comprises a current amplifier 24 for amplifying the current of the operation signal from the controller 21 and a switching transistor (to be referred to as a Tr hereinafter) 28 for ON/OFF-controlling a VIB motor 25. Note that the VIB drive circuit 22 may be constituted by an integrated circuit. The VIB motor 25 is started by the voltage of a primary battery 23 under control of the VIB drive circuit 22. A booster 27 boosts the voltage of the primary battery 23, and applies the boosted power supply voltage to the receiver 20 and the controller 21.

A detailed operation of the VIB motor drive apparatus will be described below. When the controller 21 confirms an individual call, a signal of high ("H") level is input from an output port VBQ of the controller 21 to an input port VBI of the VIB drive circuit 22. The current amplifier 24 is operated as follows. That is, the current amplifier 24 amplifies the signal of high ("H") level of the input port VBI and performs current amplification using a current from the primary battery 23. The amplified current flows into the base of the Tr 28 to turn on the Tr 28, and the collector of the Tr 28 is set at low ("L") level, thereby starting the VIB motor 25.

As another prior art, as described in Japanese Patent Laid-Open No. 63-268323, the following method is also known. That is, detection of a large current generated during calling is performed, and only when the large current is detected, the VIB motor is driven.

In the above conventional VIB motor drive apparatus shown in FIG. 2, since the primary battery 23 commonly supplies power to the current amplifier 24 and the VIB motor 25, the following problem is posed.

That is, when an internal impedance $r_0$ of the primary battery 23 is high, the VIB motor may not be driven. In recent years, although a coin-type air zinc battery is frequently used, since this battery has an impedance $r_0$ higher than that of an alkaline battery, a manganese battery, or an Ni-Cd battery which has been conventionally used, the coin-type air zinc battery may not be able to start the VIB motor.

This problem will be described below using $V_{CE}$ (collector-emitter voltage)–$I_C$ (collector current) characteristics of the Tr 28 with reference to FIG. 3. Reference numeral 33 denotes a $V_{CE}$–$I_C$ characteristic curve obtained by using a base current $I_B$ of the Tr 28 as a parameter. The base current $I_B$ of the Tr 28 increases or decreases depending on a power supply voltage Vcc of the current amplifier 24. The base current $I_B$ of the Tr 28 increases when the power supply voltage Vcc is higher, and the base current $I_B$ of the Tr 28 decreases when the power supply voltage Vcc is lower. Reference numeral 31 denotes the DC load line of the Tr 28, and the DC load line is a load line obtained by connecting an open-circuit voltage $V_0$ (indicated by reference numeral 32) of the primary battery 23 to $V_0/(r_0+r_m)$ using a straight line. Note that reference symbol $r_m$ denotes an equivalent resistance obtained while the VIB motor 25 is operated. Reference symbol $I_{0VIB}$ indicated by reference numeral 35 is the minimum operation current of the VIB motor 25. When a current larger than $I_{0VIB}$ flows in the VIB motor 25, the VIB motor 25 is operated; when a current smaller than $I_{0VIB}$ flows in the VIB motor 25, the VIB motor 25 is not operated. More specifically, since a current at an operating point A which is a crossing point between the $V_{CE}$–$I_C$ characteristic curve of the Tr 28 and the DC load line is larger than $I_{0VIB}$, the VIB motor 25 is operated. Since a current at an operating point B is smaller than $I_{0VIB}$, the VIB motor 25 is not operated. The power supply voltage Vcc of the current amplifier 24 is expressed by $Vcc=V_0-r_0\times I_{VIB}$. For this reason, when the voltage Vcc decreases because voltage drop occurs due to a current $I_{VIB}$ flowing in the VIB motor 25, the operating point is shifted to the operating point B, and the VIB motor 25 may not be operated. Therefore, even though the power supply voltage of the pager may be sufficiently high, the VIB motor does not operate when the voltage of the primary battery 23 is insufficient.

SUMMARY OF THE INVENTION

It is an object of the present invention to provide a call alarming apparatus for a paging system capable of starting a VIB motor by a primary battery having a high internal impedance.

In order to achieve the above objects, according to the present invention, there is provided a call alarming apparatus for a paging system, comprising receiving means for receiving a call number as a radio signal, alarming means driven to alarm a call when the receiving means receives a self call number, driving means for driving the alarming means by inputting a control signal to the driving means, control means for outputting a control signal to the driving means on the basis of an output from the receiving means, first power supply means for supplying power to the alarming and driving means, second power supply means automatically switched to supply power to the driving means when a power supply voltage of the first power supply means drops, and rectifying means for preventing a current from flowing from the second power supply means into the first power supply means.

DESCRIPTION OF THE PREFERRED EMBODIMENT

Figure 1:
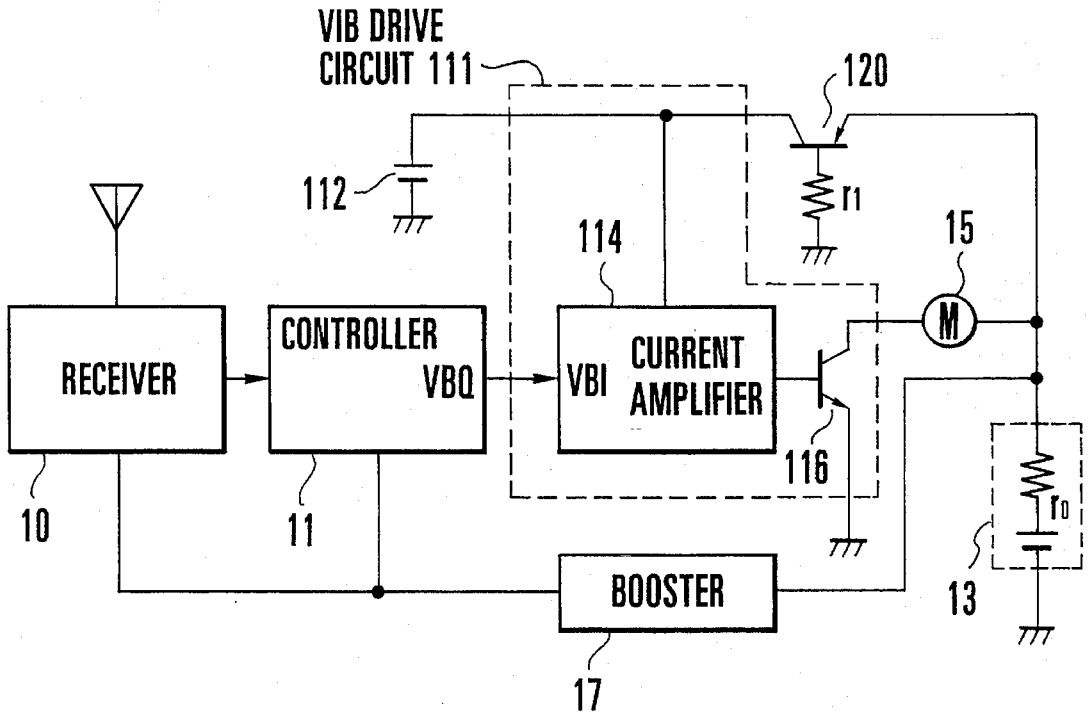
FIG. 1 is a circuit diagram showing a call alarming apparatus for a paging system according to an embodiment of the present invention.
Figure 2:
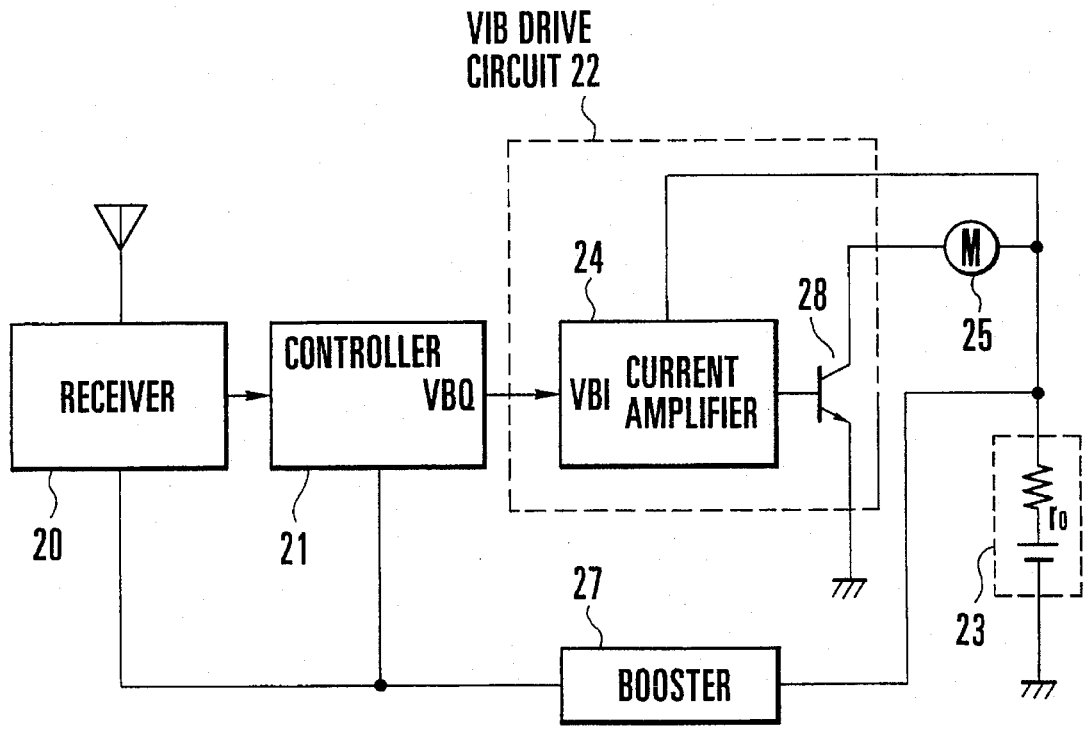
FIG.2 PRIOR ART
FIG. 2 is a circuit diagram showing a conventional call alarming apparatus for a paging system.

The present invention will be described below with reference to the accompanying drawings. FIG. 1 shows the circuit arrangement of a call alarming apparatus for a paging system according to an embodiment of the present invention.

Referring to FIG. 1, a controller 11 processes reception data input when the receiver 10 receives a self call signal as a radio signal, and the controller 11 outputs an operation signal to a VIB drive circuit 111. The VIB drive circuit 111 amplifies the current of the operation signal from the controller 11 to drive the VIB motor 15 for alarming a call. The VIB drive circuit 111 comprises a current amplifier 114 for receiving the operation signal from the controller 11 to amplify the current of the operation signal and an NPN transistor 116, having a large current amplification factor $h_{FE}$ and connected in series with the VIB motor 15, for ON/OFF-controlling the VIB motor using an output from the current amplifier 114 as a base input. Note that the current amplifier 114 may have a known arrangement constituted by a plurality of transistors and a plurality of resistors, and the VIB drive circuit 111 may be constituted by an integrated circuit. The power supply input terminal of the current amplifier 114 is connected to a primary battery 13 through a transistor 120 and also connected to a secondary battery 112 which is always floating-charged by the primary battery 13, and the primary battery 13 or the secondary battery 112 selectively supplies power to the current amplifier 114. That is, when the internal impedance $r_0$ of the primary battery 13 is low, the current amplifier 114 receives power from the primary battery 13; when the internal impedance $r_0$ of the primary battery 13 increases to decrease the power supply voltage, the current amplifier 114 receives power from the secondary battery 112. Therefore, the VIB drive circuit 111 receives power from the primary battery 13 and the secondary battery 112. When the VIB drive circuit 111 receives the operation signal from the controller 11, the VIB drive circuit 111 starts the VIB motor for vibrating the pager itself or part of the pager.

The PNP transistor 120 connected between the primary battery 13 and the power supply input terminal of the current amplifier 114 operates as a rectifying means for preventing a current from the secondary battery 112 from flowing into the primary battery 13. A booster 17 connected between the primary battery 13 and the power supply input terminal of the controller 11 boosts a voltage from the primary battery 13 to apply the boosted voltage to the receiver 10 and the controller 11. Note that, when the receiver 10 requires a power supply voltage, the booster 17 supplies power to the receiver 10. Reference symbol $r_0$ denotes the internal impedance of the primary battery 13, and reference symbol $r_1$ denotes a resistor connected between the base of the transistor 120 and ground.

A detailed operation of the VIB motor drive apparatus will be described below. When the controller 11 confirms an individual call on the basis of reception data at the receiver 10, a signal of high ("H") level is input from an output port VBQ of the controller 11 to the input terminal of the current amplifier 114 of the VIB drive circuit 111. The current amplifier 114 is operated as follows. That is, the current amplifier 114 amplifies the current of the input signal of high ("H") level using currents from the primary battery 13 and the secondary battery 112 charged with the voltage of the primary battery 13.

The amplified current flows into the base of the transistor 116 to turn on the transistor 116, and the collector of the transistor 116 is set at low ("L") level, thereby starting the VIB motor 15. When the VIB motor 15 is to be started by the primary battery 13, a relatively large VIB motor drive current flows from the primary battery 13 into the transistor 116. For this reason, even when voltage drop of the primary battery 13 occurs due to the internal impedance $r_0$, a base current $I_B$ of the transistor 116 is not adversely affected by the voltage drop of the primary battery 13 because the current amplifier 114 receives power from the secondary battery 112.

Figure 3:
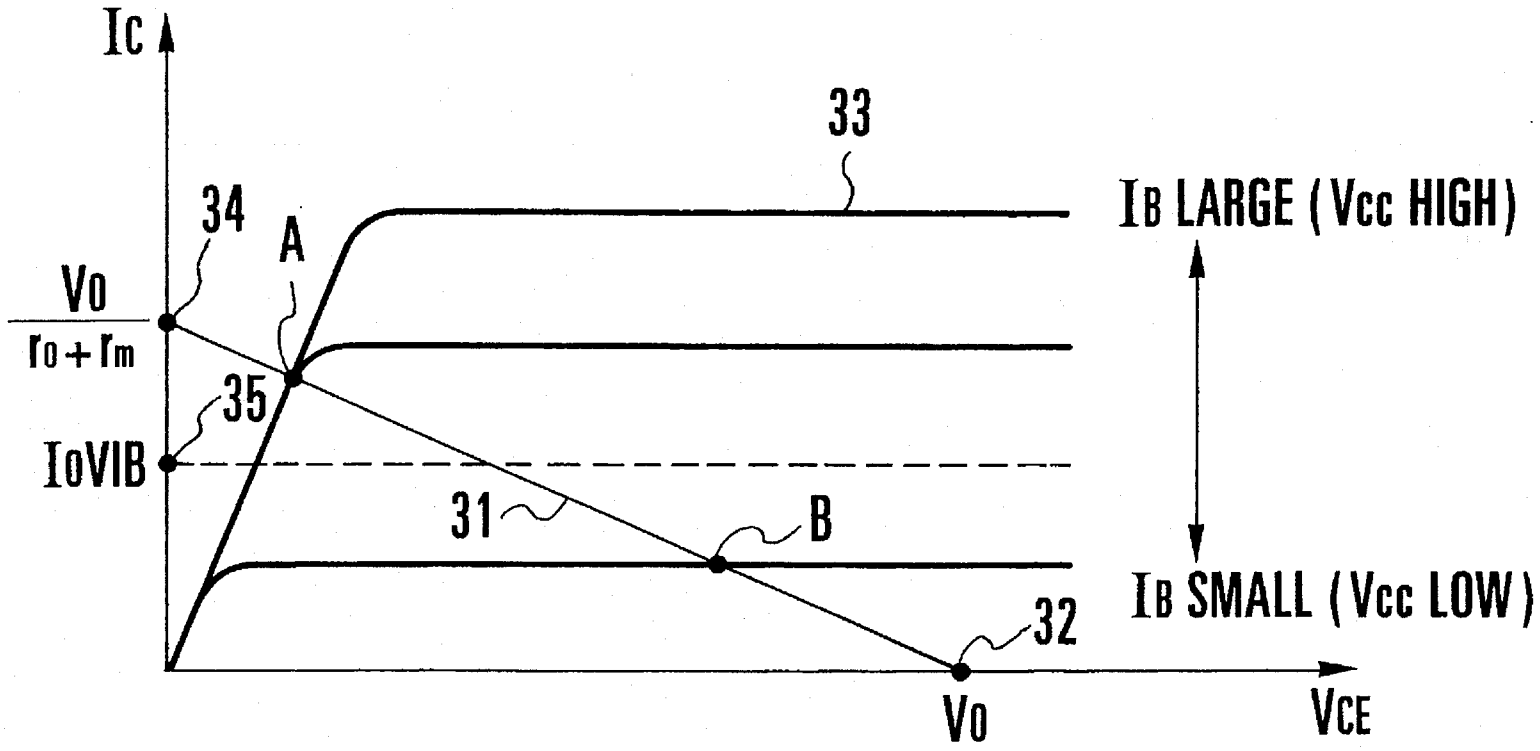
FIG. 3 is a graph showing the $V_{CE}$–$I_C$ characteristics of the switching transistor in FIG. 2.

At this time, the transistor 120 prevents a current from the secondary battery 112 from reversely flowing into the primary battery 13. Therefore, referring to FIG. 3, since the transistor 116 is turned on at an operating point A of the $V_{CE}$-$I_C$ characteristic curve of a Tr 28, an influence of voltage drop of the power supply voltage Vcc on the operation of the VIB motor 15 can be reduced.

Note that a primary battery may be used in place of a secondary battery 112 in the above embodiment.

As has been described above, in a VIB motor drive apparatus for a pager according to the present invention, an operation current for a VIB motor is supplied from a primary battery, a current for a VIB motor drive circuit is supplied from the primary battery and a secondary battery using a floating scheme. Therefore, the VIB motor drive circuit reduces voltage drop of the primary battery caused by a current flowing when the VIB motor is started, and the VIB motor drive circuit can start the VIB motor when the primary battery has an internal impedance higher than that of the primary battery of a conventional circuit.

What is claimed is:

1. A call alarming apparatus for a paging system, comprising:

receiving means for receiving a call number as a radio signal;

alarming means driven to alarm a call when said receiving means receives a self call number;

driving means for driving said alarming means by inputting a control signal to said driving means;

control means for outputting a control signal to said driving means on the basis of an output from said receiving means;

first power supply means for supplying power to said alarming and driving means;

second power supply means automatically switched to supply power to said driving means, when a power supply voltage-of said first power supply means decreases; and rectifying means for preventing a current flowing from said second power supply means into said first power supply means.

2. An apparatus according to claim 1, wherein said first power supply means is constituted by a primary battery, and said second power supply means is constituted by a secondary battery charged with a current from said primary battery.

3. An apparatus according to claim 1, wherein said first power supply means has a high internal impedance, and said second power supply means compensates a decrease in a power supply voltage from said first power supply means generated by a drive current for said alarming means.

4. An apparatus according to claim 1, wherein said driving means constituted by a current amplifier for amplifying a current of an operation signal from said control means and a switching element connected in series with said alarming means and turned on by an output from said current amplifier, said first and second power supply means selectively supply power to said current amplifier, and said first power supply means supplies power to a series-connected circuit constituted by said alarming means and said switching element.

5. An apparatus according to claim 1, wherein said rectifying means is constituted by a transistor connected between said first power supply means and a power supply input terminal of said driving means and a resistor connected between a base of said transistor and ground.

6. An apparatus according to claim 1, wherein said alarming means is constituted by a motor rotated to generate a vibration for a call.

7. A call alarming apparatus for a paging system, comprising:

alarming means for alarming a call;

driving means for driving said alarming means upon receiving a self call number;

first power supply means for supplying power to said alarming means and said driving means; and second power supply means which is chargeable and dischargeable, which is automatically recharged with a current from said first power supply means, and which is automatically switched to supply power to said alarming means when a power supply voltage of said first power supply is insufficient to supply power to said said alarming means.

8. A call alarming apparatus for a paging system, comprising:

receiving means, driving means, control means, alarming means, rectifying means, and first and second power supply means;

said receiving means, said driving means, said control means, said alarming means, and said rectifying means being powered initially by said first power supply means;

said second power supply means being switched automatically, without intervention from said control means, to provide power to said alarming means when the voltage of said first power supply means is insufficient to power said alarming means;

said second power supply means being dischargeable and rechargeable; said first power supply means automatically, without intervention from said control means, recharging said second power supply means;

said rectifying means comprising a first transistor and a resistor which is connected in series between the base of said first transistor and ground, said first transistor being a PNP transistor;

said driving means comprising a current amplifier and a second transistor, said current amplifier connected to base of said second transistor, said second transistor being an NPN transistor;

said receiving means being connected to said control means; said control means being connected to said current amplifier; said current amplifier being connected to said second power supply means and to collector of said first transistor; said first power supply means being connected to said alarming means and said emitter of said first transistor; said first power supply means being coupled with said receiving means and said control means; said alarming means connected in series between said emitter of said first transistor and said collector of said second transistor; and said emitter of said second transistor connected to ground.

* * * * *